US006570106B1

(12) United States Patent
Merrick

(10) Patent No.: US 6,570,106 B1
(45) Date of Patent: May 27, 2003

(54) MOVABLE ELECTRIC SWITCHES THAT MOVE TO REVEAL UNDERLYING CONTROL AREAS

(76) Inventor: Steven L. Merrick, 11354 Elderwood St., Los Angles, CA (US) 90049

( * ) Notice: Subject to any disclaimer, the term of this patent is extended or adjusted under 35 U.S.C. 154(b) by 103 days.

(21) Appl. No.: 09/614,096

(22) Filed: Jul. 10, 2000

(51) Int. Cl.[7] ..... H01H 13/70

(52) U.S. Cl. ..... 200/5 R; 200/1 R; 200/5 A; 200/6 A

(58) Field of Search ..... 200/1 R, 4, 6 A, 200/6 R, 17 R, 18, 1 B, 329, 333, 296, 52 R

(56) References Cited

U.S. PATENT DOCUMENTS

| | | | | |
|---|---|---|---|---|
| 3,944,763 A | | 3/1976 | Beierwaltes | |
| 4,118,611 A | | 10/1978 | Harris | |
| 4,528,431 A | | 7/1985 | Coleman, III | |
| 4,618,754 A | | 10/1986 | Gross | |
| 4,654,488 A | | 3/1987 | Westfall | |
| 4,787,040 A | | 11/1988 | Ames et al. | |
| 4,794,211 A | * | 12/1988 | Hibbert et al. | 200/16 F |
| 4,896,003 A | * | 1/1990 | Hsieh | 200/339 |
| 5,012,055 A | | 4/1991 | Matsui | |
| 5,057,657 A | | 10/1991 | Skulic | |
| 5,087,798 A | | 2/1992 | Rohde et al. | |
| 5,130,506 A | | 7/1992 | Zuercher et al. | |
| 5,196,782 A | | 3/1993 | D'Aleo et al. | |
| 5,555,502 A | | 9/1996 | Opel | |
| 5,640,296 A | | 6/1997 | Bonsall et al. | |
| 5,698,825 A | | 12/1997 | Karasik | |
| 5,739,486 A | | 4/1998 | Buckingham | |
| 5,813,519 A | * | 9/1998 | Gotoh | 200/313 |
| 5,923,319 A | | 7/1999 | Bishop et al. | |
| 5,953,199 A | | 9/1999 | Owens | |
| 6,040,824 A | | 3/2000 | Maekawa et al. | |
| 6,259,044 B1 | * | 7/2001 | Paratore et al. | 200/310 |
| 6,259,045 B1 | * | 7/2001 | Imai | 200/5 A |

* cited by examiner

*Primary Examiner*—Karl D. Easthom
*Assistant Examiner*—Kyung S. Lee
(74) *Attorney, Agent, or Firm*—Schmeiser, Olsen & Watts

(57) ABSTRACT

Electric switches are disclosed that cover underlying control areas and that can be moved to reveal these underlying control areas. The underlying control area will preferably be a control panel, such as a touch screen or hard-switched control panel. These movable electric switches are made to blend in with the surrounding decor, preferably by having a decorative plate as the predominate artifact that is seen. These movable electric switches are also functional, in that pressing on areas of the decorative plate will allow different electric switch positions to be chosen and different functions to occur that correspond to the particular electric switch position.

Thus, the present invention allows any underlying control area to be covered by a movable electric switch, allows the electric switch to be used to control various electrical devices, and allows the electric switch to be moved to provide access to the underlying control area.

21 Claims, 12 Drawing Sheets

MOVABLE ELECTRIC SWITCHES THAT MOVE TO REVEAL UNDERLYING CONTROL AREAS

BACKGROUND OF THE INVENTION

1. Technical Field

The present invention relates in general to electric switches. More specifically, the present invention relates to movable electric switched that move to reveal underlying control areas.

2. Background Art

Commercial and home automation and control)l systems are becoming more popular. Home automation systems were once reserved for only the extravagantly wealthy, but these systems are now being installed in modestly priced homes. Similarly, commercial automation and control systems are reaching a wider range of industrial uses. Many of these commercial and home automation and control systems use control panels of some sort. These control panels are usually either touch screens or "hard switches," which can have quite a few hard-wired buttons. The control panels can send commands and button switch closure information to a centrally located control system where the commands are interpreted by software. The centrally located control system then deciphers which room sent the command or button press and performs a function in response to the button press. For example, the "dim lights" button might have been pressed, and the centrally located system would respond by dimming the appropriate lights.

These automation and control systems can allow an incredible amount of control over various aspects of the home or business, including such items as the heating and air conditioning, inside and outside lighting, sprinkler systems, home theater systems, distributed music and video, internet and intranet information, security systems, and security video systems and cameras.

Unfortunately, these systems also leave control panels in various locations throughout a house or building, taking away from an otherwise aesthetic interior design.

DISCLOSURE OF THE INVENTION

Because the control panels are strewn throughout the house, they tend not to blend in with much of the house's decor. The touch screen or hard switches are simply whatever color they are and they cannot be changed. Even regular switches can be made to blend into the decor of a room. For example, a regular switch's cover plate could be wallpapered or painted. For multifunction control panels, however, it is impossible to paint or wall-paper over them without either ruining them or making them functionally useless (e.g., all the buttons will be the same, with no writing to say what the individual buttons do).

The preferred embodiments of the present invention solve these problems by providing electric switches that cover underlying control areas and that can be moved to reveal these underlying control areas. The underlying control area will preferably be a control panel, such as a touch screen or hard-switched control panel. Moreover, these movable electric switches are made to blend in with the surrounding decor, preferably by having a decorative plate as the predominate artifact that is seen. These movable electric switches are also functional, in that pressing on areas of the decorative plate will allow different switch positions to be chosen and different functions to occur that correspond to the particular switch position. For example, pressing on one side of the decorative plate might make the lights come on, while pressing on another side might make the lights go off.

Thus, the present invention allows any underlying control area to be covered by a movable electric switch, allows the electric switch to be used to control various electrical devices, and allows the electric switch to be moved to provide access to the underlying control area. Thus, the movable electric switches of the present invention are functional and aesthetic.

The foregoing and other features and advantages of the present invention will be apparent from the following more particular description of the preferred embodiment of the invention, as illustrated in the accompanying drawings.

BEST MODE(S) FOR CARRYING OUT THE INVENTION

Various movable electric switches are disclosed. Preferably, the movable electric switches have a decorative plate that is the primary artifact seen when the movable electric switch is in its covering position, which is where the electric switch completely covers an underlying control area. The underlying control area will normally contain a control panel, such as a touch screen or a hard switched control panel. The decorative plate can be made to match the decor of the room. The decorative plate can be pressed at various locations to control switch positions in the underlying electric switch. The switch positions will control electric devices, such as lights, stereos, etc. The electric switch can then be moved to reveal the underlying control area and to provide access to the underlying control area. Even when the electric switch has been moved to reveal the underlying control area, the electric switch may still be used to control the electric devices.

In the most preferred embodiment of the present invention, a four position electric switch is used underneath the decorative plate. The four position switch slides through a movement, mechanism to reveal a control panel underneath. The four position switch has four contacts, and these contacts are connected to the control panel. When one of the switch positions on the electric switch is pressed, the switch position closes a circuit. This circuit is connected to the control panel. The control panel or central control system then determines what function this circuit represents and performs this function. It is possible that the control panel could independently determine and perform the function. Alternately, the control panel could send switch closure information to a central control system, which would determine what the function represents and perform the function, perhaps by sending commands to the control panel, another control panel located in a different location, or to subsystems such as lighting controls or music systems.

In this disclosure, "movable electric switch" will refer to the entire electric switch and movement mechanism. The term "electric switch" will refer to the actual electric switch that is used to control electric devices or circuits.

Any electric switch may be used with the present invention, such as "tap" switches that operate by sensing that a finger has touched a metallic surface, toggle switches, elastomeric switches, joy-stick-type multi-position switches, two-position switches, etc. However, a four-position switch is preferred, as four positions allow quite a bit of functionality yet also are relatively simple.

It should be noted that the figures are not necessarily to scale, and that some elements have been enlarged for clarity.

Figure 1:
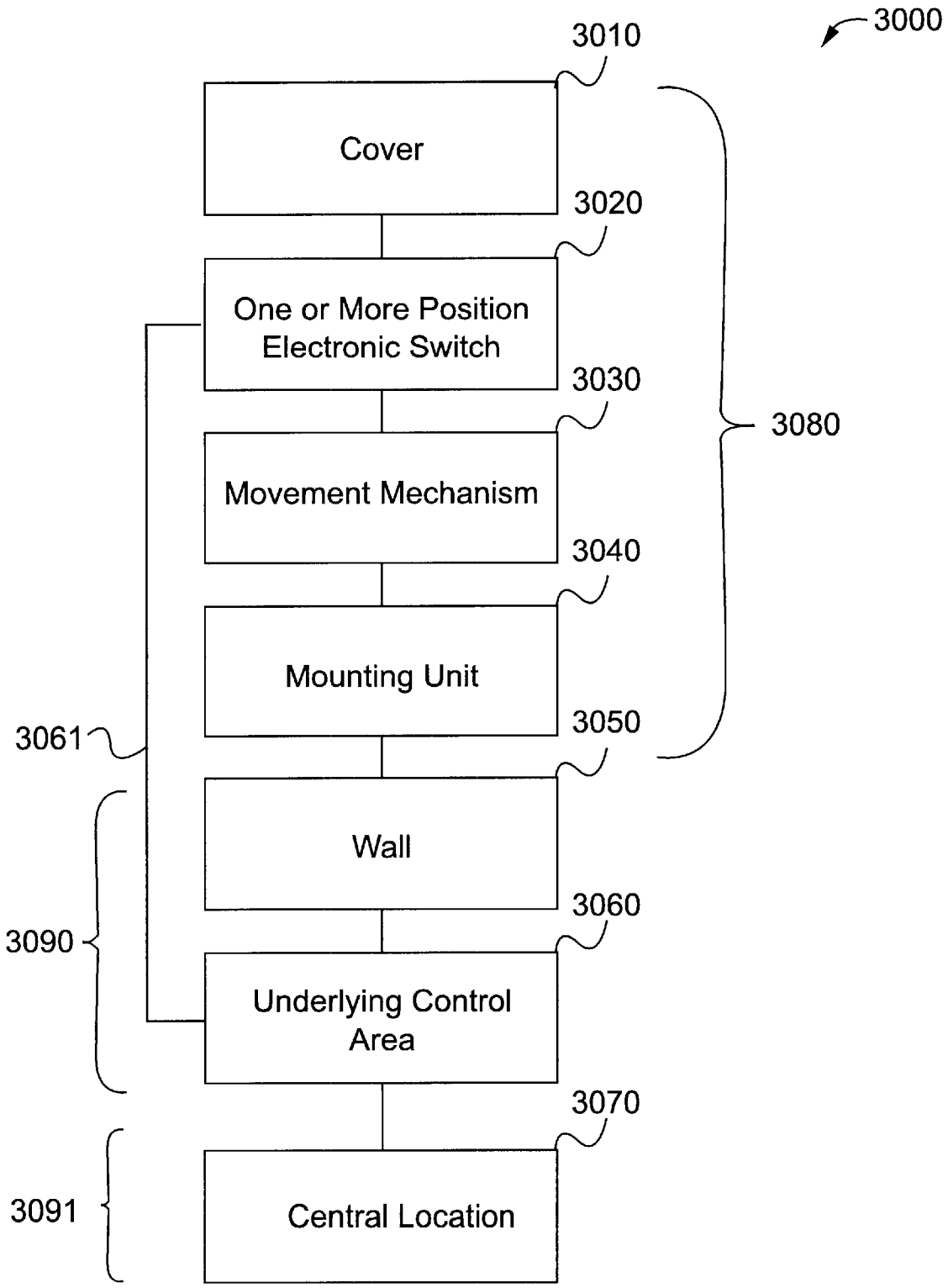
FIG. 1 is an overview of the current invention.

Referring now to FIG. 1, this figure diagrams the embodiments of the present invention in terms of preferred locations. Diagram 3000 illustrates the preferred locations for each of the various preferred mechanisms used in embodiments of the present invention. Locations 3080 are "above" a wall, locations 3090 are below or at the surface of a wall, and location 3091 is optional and usually located in a central area somewhere in the house or business. When a user of the present invention sees the invention, he or she preferably views only a cover 3010 when the movable electric switch is in its covered or covering position. The cover 3010 preferably blends into and is coordinated with the decor of the room. Thus, the cover 3010 could be made of metal, wood, natural or artificial stone, etc. Beneath the cover 3010 and preferably separate from the cover 3010 is a one or more position electric switch 3020. Preferably, the electric switch 3020 has four positions, each position able to complete a circuit. Thus, the electric switch is able to control one or more electric functions.

While the cover 3010 and switch 3020 could be integrally made, by allowing these to be separate, the cover 3010 can be changed more easily to fit into different decors. For instance, one house might need a marble cover, while another house might need a paginated copper cover. Building both of these integrally with the electric switch will be relatively expensive and is thus not preferred, although it is possible.

Beneath the electric switch 3020 is a movement mechanism 3030. The cover and its underlying switch cover an underlying control area, which can be any area where one would like to access the underlying control area yet also have the area covered when not being accessed. Most preferably, the underlying control area is occupied by a control panel, which could be a touch screen or hard switched control panel. The movement mechanism allows the cover and its underlying switch to be moved away from the underlying control area and allows the underlying control area to be accessed. When the cover and electric switch are moved through the use of the movement mechanism, they may be moved until they are in a fully exposed (or fully uncovered) position. This position allows the maximum access to the underlying control area. Most preferably, the electric switch is still able to be used when it is in the fully exposed position, or during any position between the fully covered and fully exposed positions.

The movement mechanism 3030 can be any mechanism that allows the electric switch to cover an underlying control area, yet allow the electric switch to be moved to uncover and reveal at least part of the underlying control area. The most preferred movement mechanism comprises edges on a bottom plate and grooves, the edges moving through the grooves. This mechanism allows the electric switch to be slid parallel to the wall and away from the underlying control area (or toward and over the underlying control area). Other preferred movement mechanisms comprise a hinge that allows rotational movement about one axis.

The movement mechanism is attached to a mounting unit 3040 and the mounting unit is attached to the wall 3050 or directly to the underlying control area 3060. The mounting unit 3040 is optional but preferred. If the mounting unit is not used, the movement mechanism 3030 may be attached directly to the wall 3050 or the underlying control area, such as a control panel. Additionally, the underlying control area and wall may overlap, such that the wall is in part of the underlying control area. The mounting unit 3040 is preferred, as it makes for a much better looking appearance.

When a user selects one of the positions of the electric switch, the selected position will complete a circuit. Most preferably, this is a low or no voltage circuit. The electric switch is connected to the underlying control area through connection 3061. Most preferably, the underlying control area 3060 is a control panel for a commercial or home automation system. Connection 3061 is any connection that can route signals from the electrical switch 3020 to the control panel 3060. When the circuit completes, the control panel 3060 will determine that the circuit has completed. As is known in the art of commercial and home automation, control panels usually report to a central location 3070. As such, the control panel sends a report to the central location that one position of the electrical switch has been closed. Usually, this report contains a designation of which control panel is the reporting control panel. The central location then determines which control panel sent the report, what the report is, and what action should be taken for this report. The central location sends a command back to the control panel or causes the appropriate action to be taken. Alternatively, the control panel could itself interpret the closing of the circuit and take action based on the circuit. For instance, the control panel could be an X10 controller that would transmit a command to particular devices.

It should be noted that spring connector 7010, along with its contact springs and contact runs, may be replaced by any mechanism that allows the electric switch to be moved yet also retains an electrical connection between the electric switch and the control panel. For example, this system could be replaced by a ribbon cable. Any mechanism for interconnecting an electric switch and an electric device may be used for this connection.

Figure 2:
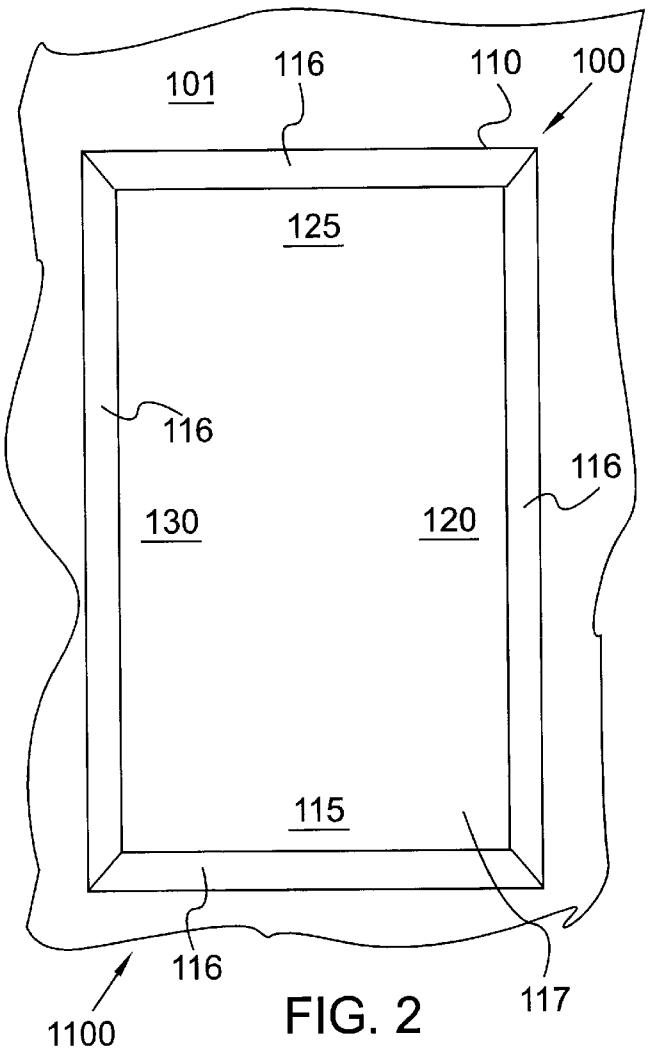
FIG. 2 is a front view of a movable switch in its covering position, in accordance with the most preferred embodiment of the present invention.

Turning now to FIG. 2, this figure illustrates the most preferred embodiment of the present invention. Movable electric switch system 1100 has wall 101 and a movable electric switch 100 that has a decorative plate 110. Decorative plate 110 has a flat portion 117 and a beveled surface 116. Beveled surface 116 is exemplary and is preferred in some installations and with some materials. However, the decorative plate 110 need not have a beveled surface 116. Movable electric switch 100 is shown as it would exist on wall 101. Decorative plate 110 may be made from any material, such as granite, marble, wood, fine metals, etc. Additionally, it may be wall-papered, painted, anodized, paginated, etc. The decorative plate can be made in any shape, although rectangular is easiest to fabricate. Ideally, the material and finish are made to blend in with the decor of the room. Decorative plate 110 may be as ornate as desired or may be as simple as FIG. 2 suggests. The decorative plate 110 in FIG. 2 is only exemplary.

When an operator walks up to movable electric switch 100, the decorative plate 110 would be all the operator preferably sees. In the most preferred embodiment of the present invention, the electric switch (not shown until later figures) that underlies decorative plate 110 is a four position electric switch. Each position, when the decorative plate is pressed in the appropriate location, will close a circuit. This closed circuit is then delivered to the underlying control panel, which then uses this information to control an electric device.

In the example of FIG. 2, there are four locations 115, 120, 125, and 130 that each correspond to one position of a four position electric switch. When an operator presses on the decorative plate 110 enough to cause one of the positions to be selected and for that position to close the circuit corresponding to that position, the underlying control panel will determine which circuit has been competed and what the appropriate action for that circuit is. For instance, if an operator presses and releases location 125, the lights could come on. If an operator presses and releases location 115, the lights could go off. If an operator presses and holds location 125, the lights could brighten. On the contrary, if an operator presses and holds location 115, the lights could dim. If an operator presses and releases location 120, the stereo could come on. If an operator presses and releases location 130, the stereo could turn off. If an operator presses and holds location 120, the stereo will increase the volume. If an operator presses and holds location 130, the stereo will decrease the volume. As is known in the art, each button press is a completed circuit and a commercial or home automation system can be programmed to perform any function associated with the completed circuit. The function or functions chosen for each completed circuit may be selected by a software programmer, who programs the commercial or home automation system. Any mechanism able to be controlled by the commercial or home automation system may be associated with a completed circuit, and the discussion herein of which devices are associated with particular switch positions is only exemplary.

Thus, FIG. 2 shows that the movable electric switch of the present invention will be unassuming when it is in its covering position. However, it is also functional in that, in the most preferred embodiment, it can control four or more functions.

Figure 3:
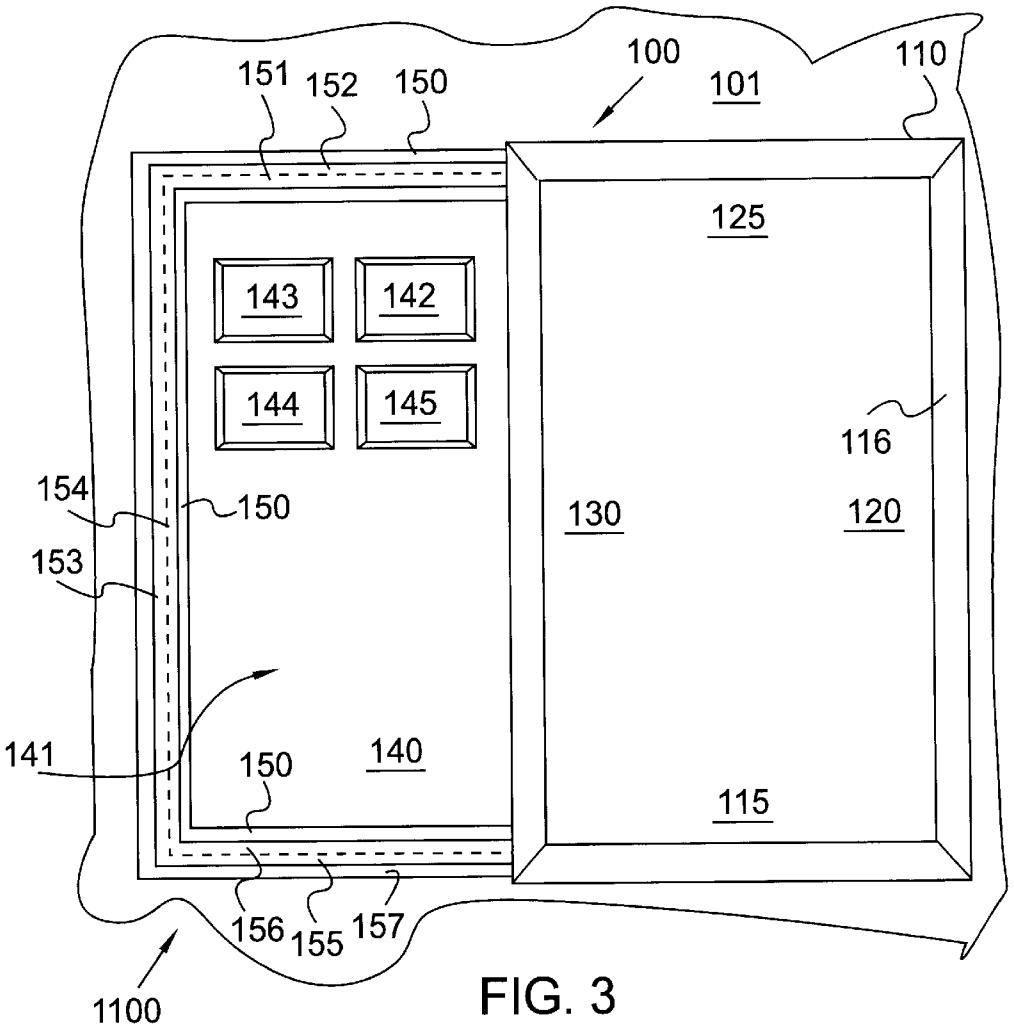
FIG. 3 is a front view of a movable switch in its exposing position, in accordance with the most preferred embodiment of the present invention.

Turning now to FIG. 3, this figure shows a movable electric switch system 1100 that shows the movable electric switch 100 on wall 101 and in a fully exposed or uncovered position. In this position, the decorative plate 110 is slid to the right and the underlying control area 141 is shown. Ideally, as much as possible of the underlying control area will be shown when the movable electric switch is in its fully exposed position. Movable electric switch 100 further has a base 150 that is attached to wall 101. Base 150 has, on its surface 157, side rail 153 having groove 154, top rail 151 having groove 152, and bottom rail 155 having groove 156.

Movable electric switch system 1100 comprises a control panel 140 in underlying control area 141. Control panel 140 has a number of buttons 142, 143, 144, and 145, that allow an occupant to control various features of the house. Control panel 140 could be a touch screen or a control panel with hard switches. Grooves 152, 154, and 156 allow a bottom plate (not shown until later figures) to slide in the grooves. The bottom plate's edges and grooves comprise a movement mechanism that allows the decorative plate 110 (and the underlying electric switch, to be shown in later figures) to be moved to uncover the underlying control area 141. In this uncovered or exposed position, an operator has access to the control panel 140 and the underlying control area 141.

Also in this position, the operator may still operate movable electric switch 100 by pressing any or all of the areas 115, 120, 125, and 130. Although it is possible to disable the electric switch when the movable electric switch is in the fully exposed position, this is undesirable. It is more desirable to have the electric switch maintain its functionality when the movable electric switch is in the fully exposed position or any position. Preferred electric switches are described in reference to upcoming figures. In these figures, the electric switch is assumed to be low voltage, in the sense that positions on the switch simply complete a circuit and the circuit would have very low voltage. Ideally, the completion of a circuit is performed by connecting a floating or unconnected part of the circuit to ground. Thus, only ground, which is a very low voltage (essentially zero volts) would be in the electric switch, and control panel circuitry could judge whether a circuit is complete or not by measuring resistance. If there is high resistance, the circuit is not complete; if there is a low resistance, the circuit is complete. Alternatively, a small Direct Current (DC) current or voltage, such as five volts or lower, may be used in the circuits and the completion of a circuit can be determined by zero potential difference or other methods. It is also possible to have the electric switch have a higher voltage, such as having the electric switch carry 110 volts. However, this is not recommended, as it might be possible to come into contact with the wiring that connects the control panel (or other underlying device) to the electric switch. This could be dangerous. Therefore, the electrical switches discussed herein will be considered to be very low voltage or zero voltage devices.

Underlying control area 141 could be any area that one would want to cover with the movable electric switches of the present invention. In general, the preferred and primary use of the present invention will be to cover control panels associated with commercial and home automation, as the movable electric switches of the current invention provide functionality, allow the control panels to be covered, allow the movable electric switch to blend into the decor of the room, and yet allow the control panels to be easily accessed.

Figure 6:
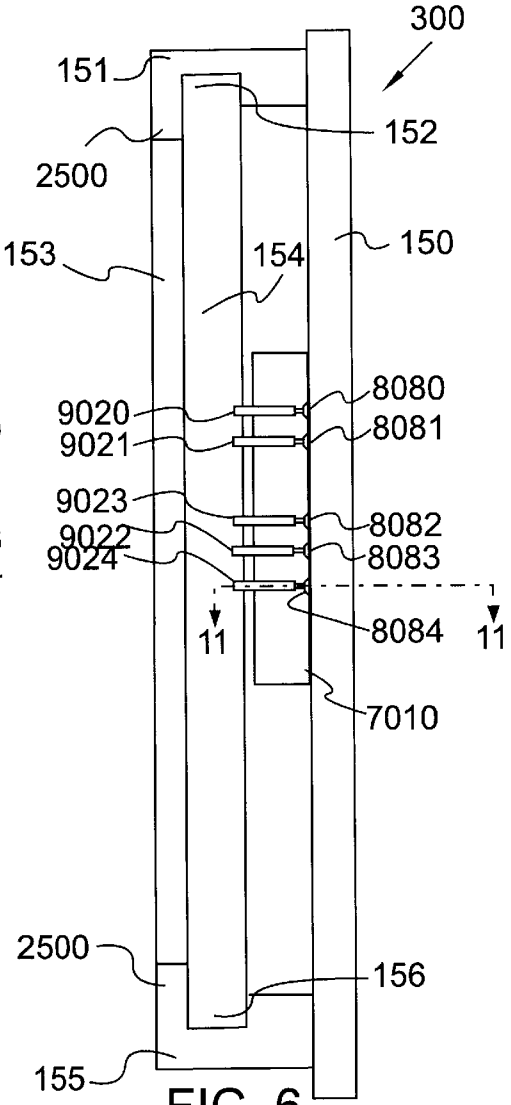
FIGS. 4, 5, and 6 are front, left, and right views, respectively, of a main mounting unit in accordance with the most preferred embodiment of the present invention.
Figure 5:
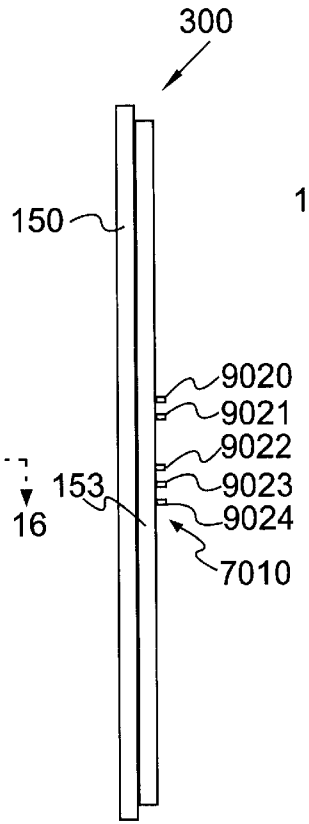
Figure 11:
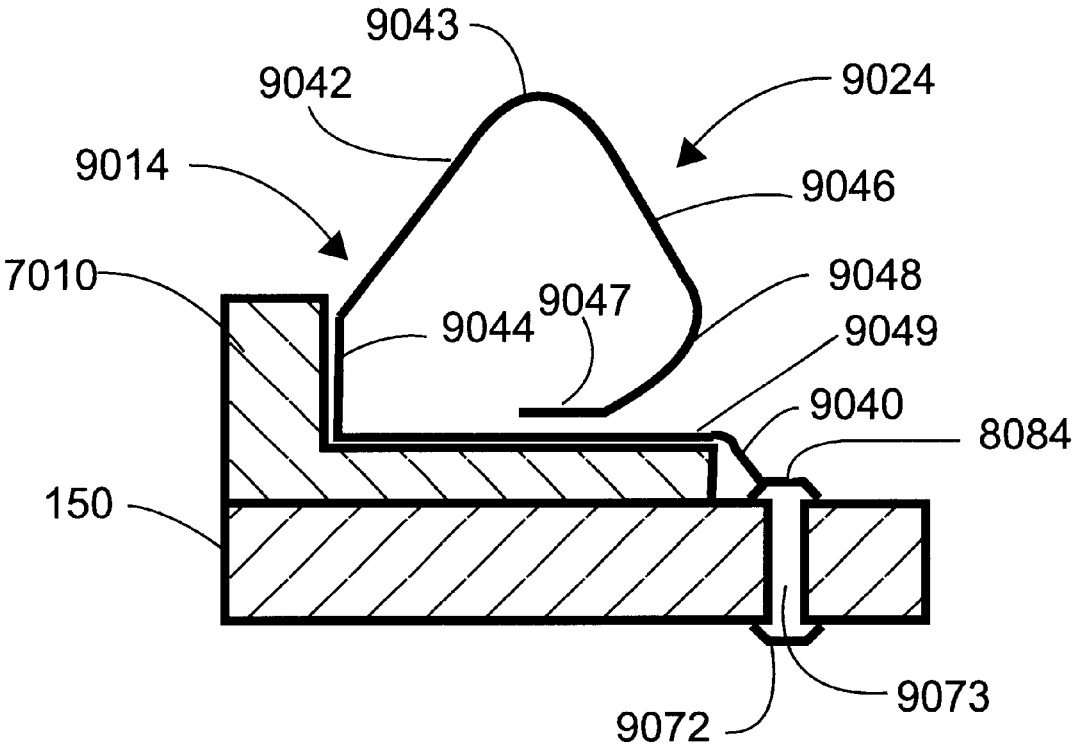
FIG. 11 is a cross-sectional view of a spring connector and one of its spring contacts in accordance with a preferred embodiment of the present invention.
Figure 13:
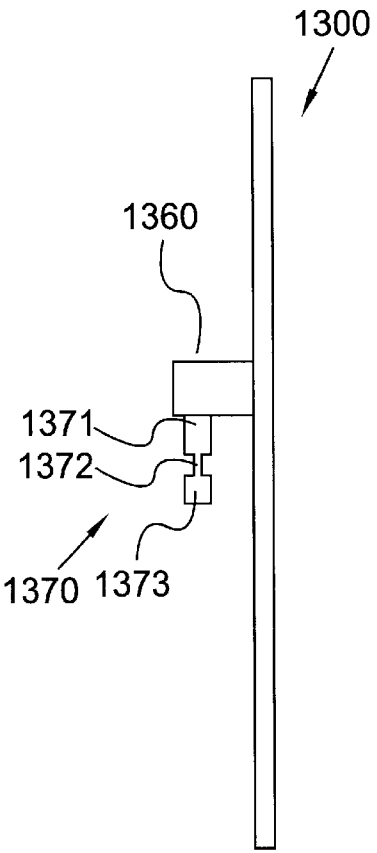
FIGS. 12, 13, 14, and 15 are front, left, rear and top views, respectively, of a top switch unit in accordance with the most preferred embodiment of the present invention.

Turning now to FIGS. 4 through 6 and FIG. 11, FIG. 4 shows a front view of a mounting unit 300, FIG. 5 shows a left side view of the mounting unit 300, FIG. 6 shows a right side view of the mounting unit 300, and FIG. 11 shows a cross-sectional view of a spring connector and one of its spring contacts. Mounting unit 300 comprises a base unit 150 having a top surface 157 and an opening 160, side rail 153 having groove 154, top rail 151 having groove 152, and bottom rail 155 having groove 156. Base unit 150 in this example comprises screw recesses 5070, and top surface 5050. Rails 153, 151, and 155 each have a surface 3201 and will generally be formed from one plate of metal, although the rails may be separate entities. Additionally, screws 3200 removably attach rails 153, 151, and 155 to base unit 150. Rails 153, 151, and 155 can be removably or permanently attached to base unit 150 in any manner known to those skilled in the art, such as through welds, glue, screws, rivets, etc. Additionally, base unit 150 and rails 153, 151, and 155 may be machined as one piece. If screws 3200 are used to attach the rails 153, 151, and 155 to the base 150, it is preferred that the screws mount flush to surfaces 3201, as shown in FIGS. 5 and 6.

Figure 4:
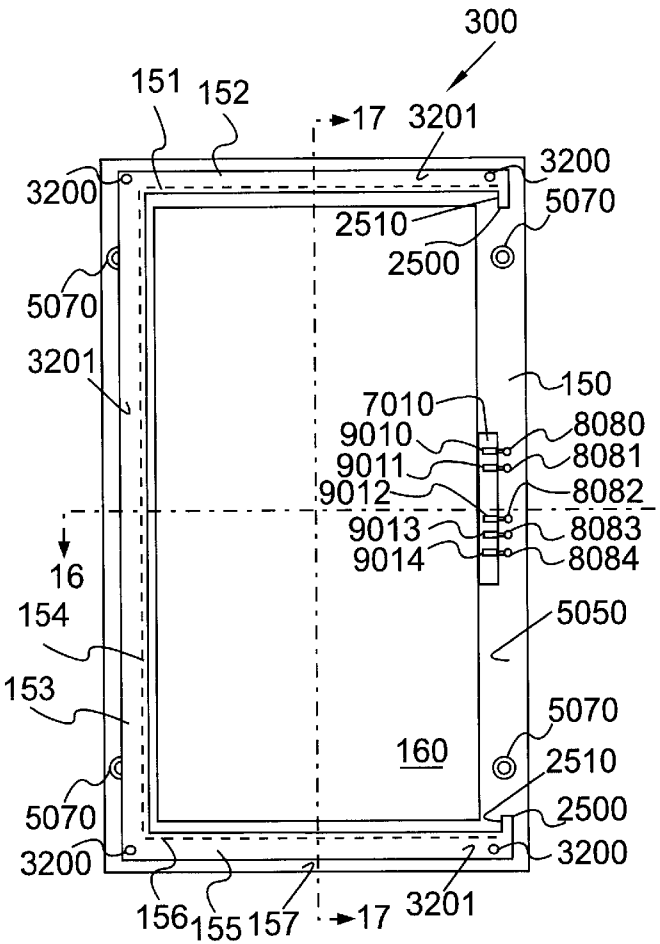
Figure 8:
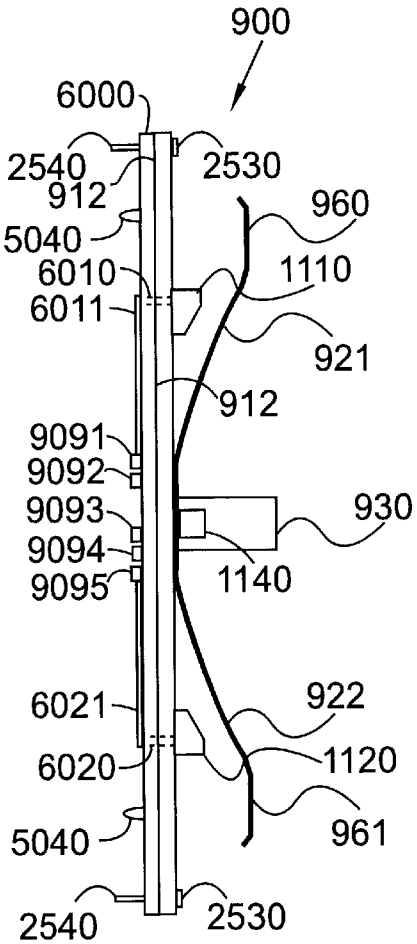
FIGS. 7, 8, 9, and 10 are front, left, rear and top views, respectively, of a bottom switch unit in accordance with the most preferred embodiment of the present invention.

Also shown in FIG. 4 are screw recesses 5070 through which recessed screws will mount the base unit 150 to a wall. The mounting method or mechanism used will depend on the wall and the materials covering the wall. Screw recesses 5070 are only exemplary. As shown in FIGS. 2 and 3, base unit 150 will be attached to wall 101, generally through removable devices. However, the base unit 150 may be removably or non-removably attached to wall 101 through any mechanism known to those skilled in the art, such as screws, glue, wall anchors, etc.

Figure 7:
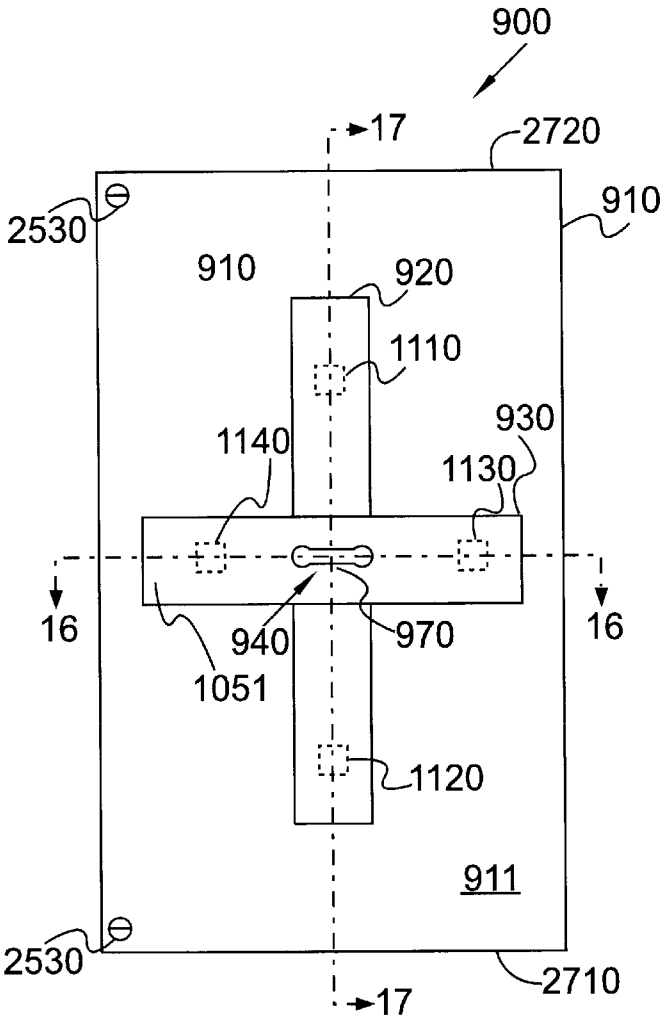
Figure 9:
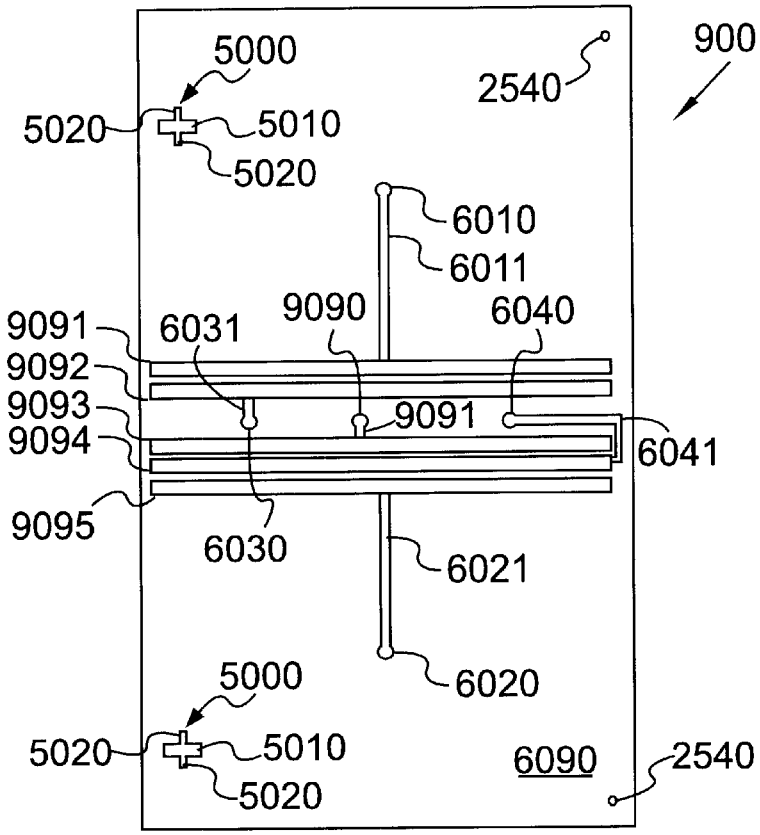
Figure 10:
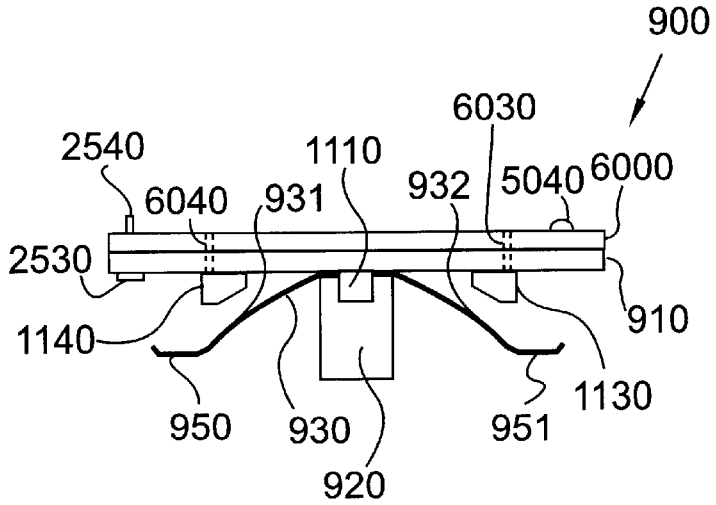

Opening 160 allows access to underlying control area 141 (see FIG. 3) and it preferably surrounds the underlying control area 141. Rails 151, 156 comprise stop mechanisms 2500 that are used to stop the bottom switch unit (shown in FIGS. 6 through 10). Stop mechanisms 2500 comprise stop surface 2510. Turning briefly to FIGS. 7 and 10 in addition to FIGS. 4 through 6, FIGS. 7 and 10 show a bottom switch unit 900 that comprises a bottom plate 910. Passing into and through bottom plate 910 are set pins 2530 that have a pin section 2540. These pin section 2540 of set pins 2530 will abut stop surfaces 2510 when the electric switch is in its fully exposed position, where the underlying control area in opening 160 is as fully exposed as the stop mechanisms and stop surfaces allow.

Spring connector 7010 comprises a number of spring contacts 9020, 9021, 9022, 9023, and 9024 that fit into openings 9010, 9011, 9012, 9013, and 9014, respectively. Each spring contact is electrically connected to surface pads 8080, 8081, 8082, 8083, and 8084, respectively, which allow each spring contact to be connected to a control panel or other device residing in the opening 160. Referring more particularly to FIG. 11, one of the spring contacts 9023 is shown residing in opening 9013. Spring contact 9023 is preferably made of one conductive material such as copper. Spring contact 9023 and spring connector are very similar to the contact and connector in a battery connector (having a number of 50605) that is used in an AUDIOVOX phone model MVX406, Federal Communications Commission Identification BFYM3008.

Top section 9043 contacts conductive runs on the bottom switch unit 900 (see FIGS. 7 through 10). Riser section 9044 connects to straight section 9042, and second straight section 9046 connects to rounded section 9048 and bottom section 9047. Plate 9049 supports and is part of the spring contact 9023. Down section 9040 electrically connects the spring contact to surface pad 8084. Through hole 9073 electrically connects surface pad 8084 with surface pad 9072. Preferably, top section 9043, riser section 9044, straight section 9042, second straight section 9046, rounded section 9048, bottom section 9047, and plate 9049 are all made of one metal. Surface contact 9072 may be used to connect the contact spring 9024 to a control panel. If base unit 150 is made of metal, then the surfaces of the base unit that contact through hole 9073 and surface contacts 8084, 9072 may have to be electrically insulated. Alternatively, an insulated wire could run from down section 9040 through hole 9073 and to a control panel.

The spring connector's shape allows it to have quite a bit of give and take in the vertical direction and some give and take in the horizontal direction. In particular, bottom section 9047 can slide on plate 9049, allowing rounded section 9048 to also slide on plate 9049. This allows the spring contact 9024 to compress to a large degree. Thus, the spring contact can maintain electrical contact with a contact run while the bottoms switch unit (see FIGS. 7 through 10), yet also allow for some vertical movement in the spring contact and bottom switch unit.

Referring now to FIGS. 7 through 10, these figures illustrate front, left side, rear, and top views, respectively of bottom switch unit 900. The top view in FIG. 10 focuses in on the bottom switch unit 900 with set pins. Bottom switch unit 900 comprises a bottom plate 910, having front side 911, back side 912, bottom edge 2710, and top edge 2720, top 1110, bottom 1120, right 1130, and left 1140 contacts, vertical contacting spring 920, horizontal contacting spring 930, set pins 2530, support wheel recesses 5000 having support wheels and pivot 940. Bottom switch unit 900 also preferably comprises a circuit board 6000 that comprises contact runs 9091, 9092, 9093, 9094, and 9095, runs 6011, 6041, 6021, 6031, and 9091, through holes 6010, 6040, 6020, 6030, and 9090, and support recesses 5000. Circuit board 6000 is preferably a normal resin-epoxy type of circuit board produced through industry standard practices and is attached to the bottom plate 910 through gluing or other means such as screws, plastic retainers, rivets, etc. The contact runs, runs, and through holes are also produced through industry standard practices. Through holes 6010, 6020, 6030, 6040 are preferably integral with top 1110, bottom 1120, right 1130, and left 1140 contacts, respectively. Alternatively, the contacts may be electrically connected to through holes 6010, 6020, 6030, 6040 through any process known to those skilled in the art.

Each contact run 9091, 9092, 9093, 9094, and 9095 will meet with one spring contact 8080, 8081, 8082, 8083, and 8084 (see FIGS. 4 through 6). This allows the spring contact to slidably engage the contact run and create an electrical connection between them yet still allow the bottom switch plate 910 to be moved relative to the base unit 300 (see FIG. 4). It is preferred that each spring contact maintain its electrical connection with its respective contact run through the bottom switch plate's entire range of motion.

Pivot 940 will be described in more detail in reference to FIGS. 16 and 17. Pivot 940 allows a top switch unit (to be described in reference to FIGS. 12 through 15) to pivot, causing vertical 920 and horizontal 930 contacting springs to touch contacts 1110, 1120, 1130, and 1140.

Figure 20:
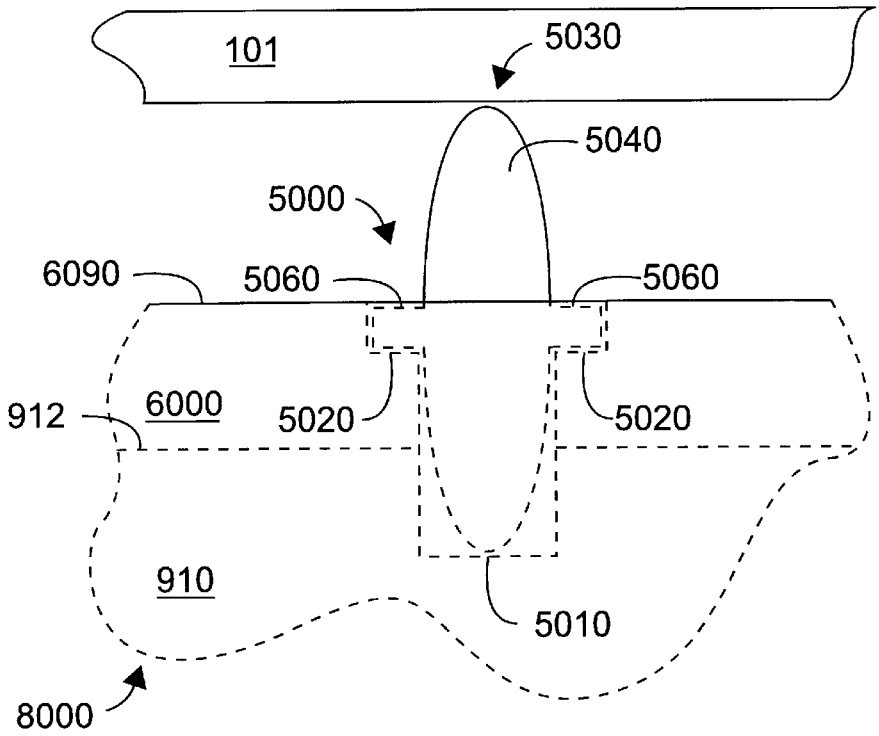
FIGS. 20 and 21 are front and side views of support wheels in wheel recesses, in accordance with a preferred embodiment of the present invention.
Figure 21:
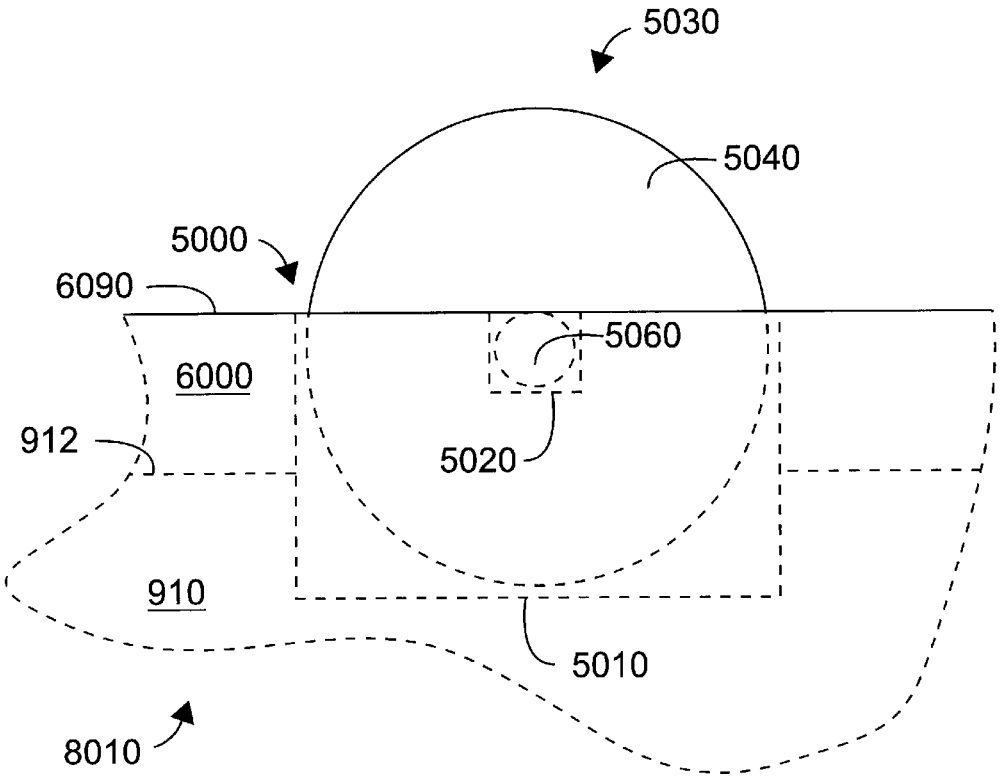

FIGS. 20 and 21 show front and side views, respectively, of support wheels 5030 placed into support wheel recesses 5000. Shown in FIG. 20 is a portion 8000 of bottom switch unit 900, while FIG. 21 shows a portion 8010 of bottom switch unit 900. Support wheels 5030 are optional but preferred, as they will support the movable switch and, in particular, the bottom switch unit 900 during movement of the electric switch. The support wheels 5030 will ride on wall 101. Support wheels 5030 comprise disk 5040 and support appendages 5060. Support wheel recesses 5000 are sized to accept support wheels 5030. Support cavities 5020 are sized to accept and preferably retain support appendages 5060. Similarly, disk cavities 5010 are sized to accept disks 5040 and allow the disks 5040 to freely rotate. Support wheels 5030 are preferably molded from one piece of hard plastic. Alternatively, the disk 5040 may be made of one material, such as plastic, and the support appendages 5060 made of a separate material. Additionally, support appendages 5060 may be made of a single pin that is press fit into and pierces through disk 5040.

Run 9093 in this example should preferably be connected to ground, when the spring connector 8082 (see FIG. 4) connects to the control panel (not shown). This allows the control panel to detect which circuit is being completed by the operator of the electric switch. The detection in this case would occur by detecting the amount of resistance in a circuit. If the resistance is high, the circuit is open; if the resistance is low, the circuit is closed. Alternatively, a voltage could be applied through spring contact 8082 and thus through hole 9090 and to the vertical contacting spring 920 and horizontal contacting spring 930. In this scenario, when a contact is made, the appropriate run 9091, 9092, 9094, 9095 will have a voltage on it.

Vertical contacting spring 920 comprises an underside 921, a middle 970, and two ends 960, 961. Horizontal contacting spring 930 comprises an underside 932, a middle 970, and two ends 950, 951. The vertical 920 and horizontal 930 contacting springs preferably can be bent many times without failure, provide enough mechanical resistance to spring back into a normal position, and also are conductive enough to be able to complete a circuit. Most preferably, they are made of a thin metal, such as copper or spring steel.

Ends 960, 961 of vertical contacting spring 920 are spaced away from the front side 911 of the bottom plate 910, and thus arc away from the middle 970 of the vertical contacting spring 920. Additionally, the ends 960, 961 are preferably bent approximately parallel to front side 911. This allows the ends 960 to meet and slide on the pivot plate 1301 (see FIG. 12). Similarly, ends 950, 951 of horizontal contacting spring 930 are spaced away from the front side 911 of the bottom plate 910, and thus arc away from the middle 970 of the horizontal contacting spring 930. Also similarly, the ends 950, 951 are preferably bent approximately parallel to front side 911. This allows the ends 950 to meet and slide on the pivot plate 1301 (see FIG. 12). While having the ends 950, 951, 96, 961 be parallel to the front side 911 is not necessary, it is preferred, as this will proved a better seating surface and smoother action.

If desired, each vertical 920 and horizontal 930 contacting spring can be split into more than one part and each part may be attached to bottom plate 910. However, this will increase complexity, and thus having one-piece vertical 920 and horizontal 930 contacting springs are preferred.

Figure 16:
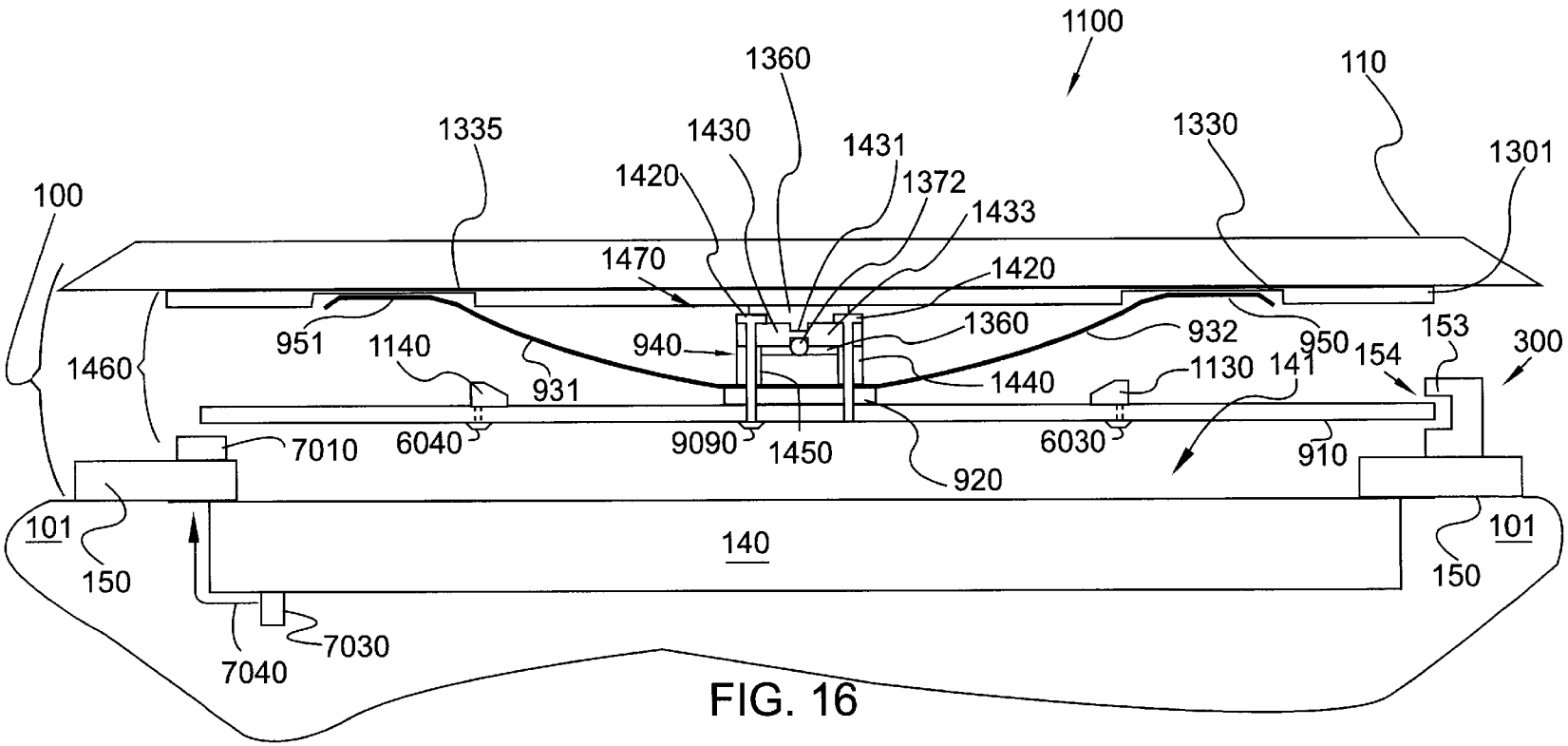
FIG. 16 is a cross-sectional view along sectional line 16 of the most preferred embodiment of the present invention.
Figure 17:
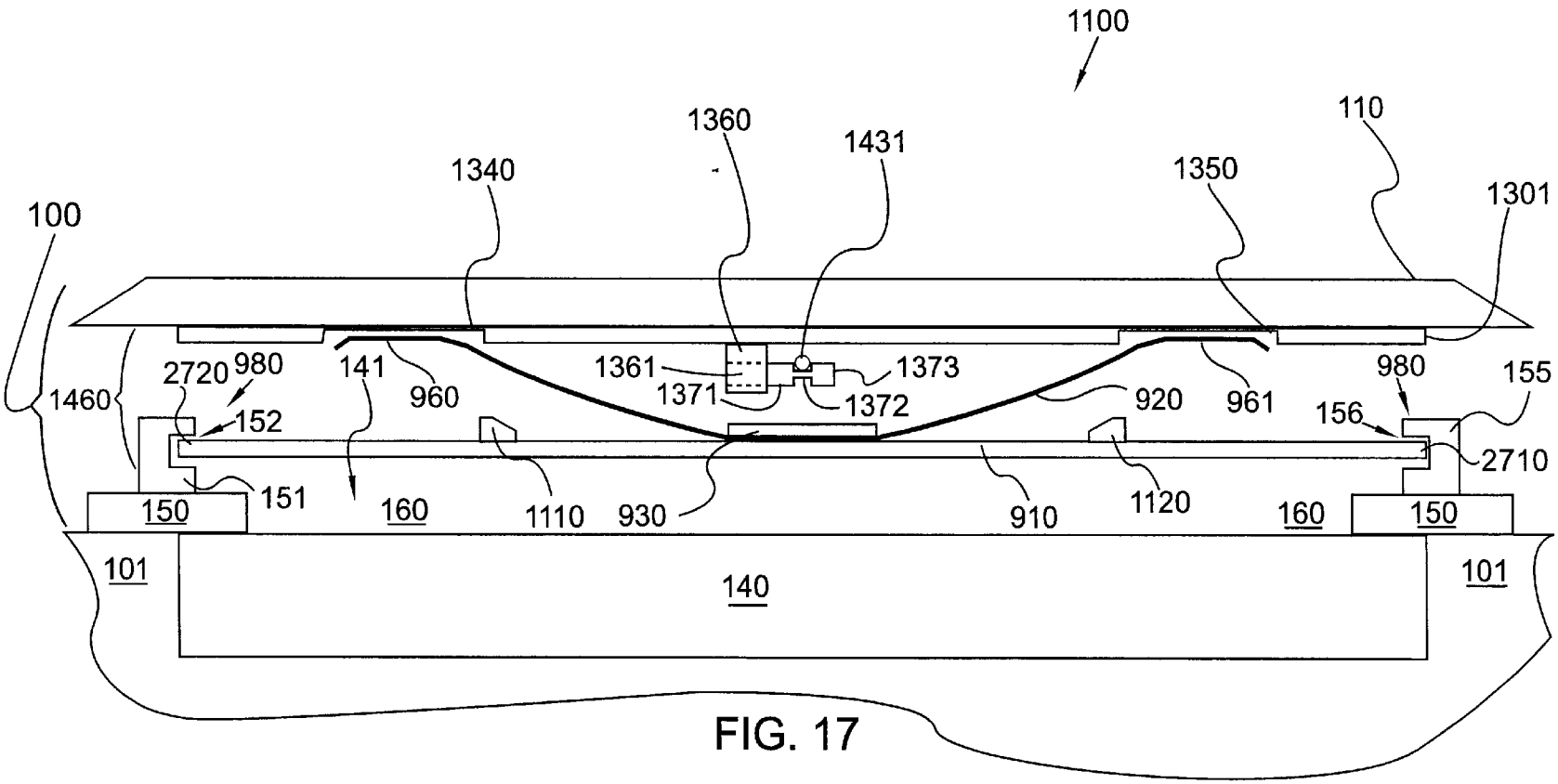
FIG. 17 is a cross-sectional view along sectional line 17 of the most preferred embodiment of the present invention.

Underside 921 of vertical contacting spring 920 will touch contact 1110 when the vertical contacting spring is compressed by an operator operating the electric switch (see FIG. 16 and 17 for more complete details). Thus, contacting spring 920 and its contact 1110 provide one position of the electric switch. Underside 922 of vertical contacting spring 920 will touch contact 1120 when the vertical contacting spring is compressed by an operator operating the electric switch. Thus, contacting spring 920 and its contact 1110 provide a second position of the electric switch. Underside 932 of horizontal contacting spring 930 will touch contact 1130 when the vertical contacting spring is compressed by an operator operating the electric switch. Contacting spring 920 and its contact 1110 provide a third position of the electric switch. Finally, underside 931 of horizontal contacting spring 930 will touch contact 1140 when the vertical contacting spring is compressed by an operator operating the electric switch. Contacting spring 920 and its contact 1110 provide a fourth position of the electric switch.

It should be noted that spring connector 7010, its contact springs, and contact runs may be replaced by any mechanism that allows the electric switch to be moved yet also retains an electrical connection between the electric switch and the control panel. For example, this system could be replaces by a ribbon cable. Any mechanism for interconnecting an electric switch and an electric device may be used for this connection.

Turning now to FIGS. 12 through 15, front, left, rear, and top views, respectively, of top switch unit 1300 are shown. Top switch unit 1300 comprises pivot plate 1301 having front 1310 and back 1320 sides, right 1330, left 1335, top 1340, and bottom 1350 alignment depressions, locations 115, 120, 125, and 130, openings 1379, and standoff 1360 having pivot pin 1370. Pivot pin 1370 preferably comprises a connecting body 1371, a notch 1372, and an end body 1373. Front side 1310 is where decorative plate 110 (see FIGS. 1 through 3) would be attached. Screws 1378 preferably pass through openings 1379 and removably connect standoff 1360 to back side 1320.

Standoff 1360 is preferably a block of metal or plastic that is attached to back side 1320 of pivot plate 1301. Standoff 1360 may be attached to back side 1320 through any method known to those skilled in the art, such as through glue, welding, screws, pins, rivets, etc. Most preferably, the standoff 1360 is a block of metal attached to the pivot pate 1301 through 1301 by screws 1378 that pass through pivot plate 1301 and through openings 1379. Pivot pin 1370 may be integrally made with standoff 1360, such as if they are Computer Numeric Controlled (CNC) machined from one piece of metal. Alternatively, pivot pin 1370 may be made separately from standoff 1360 and press fit into the standoff, glued into a cavity (not shown) in the standoff, made with a male screw on connecting body 1371 that mates with a female receptacle (not shown) in the standoff, etc. If the pivot pin 1370 and standoff 1360 are separately made, any mechanism for attaching pivot pin 1370 to standoff 1360 may be used.

As previously discussed, pivot pin 1370 preferably comprises a connecting body 1371, a notch 1372, and an end body 1373. Connecting body 1371 connects the pivot pin to the standoff 1360. Standoff 1360 is sized and pivot pin 1370 is placed such that the pivot pin's 1370 notch 1372 can meet the thinner location 1431 of the pivot bar 1433. This is shown in much greater detail in FIGS. 16 and 17. Connecting body 1371 and end body 1373 limit the vertical movement of the thinner location 1431 and its associated pivot bar 1433. Notch 1372 is preferably a thinner region of the pivot pin 1370, and may be made by turning the pivot pin 1370 on a lathe and removing material to create notch 1372.

Figure 12:
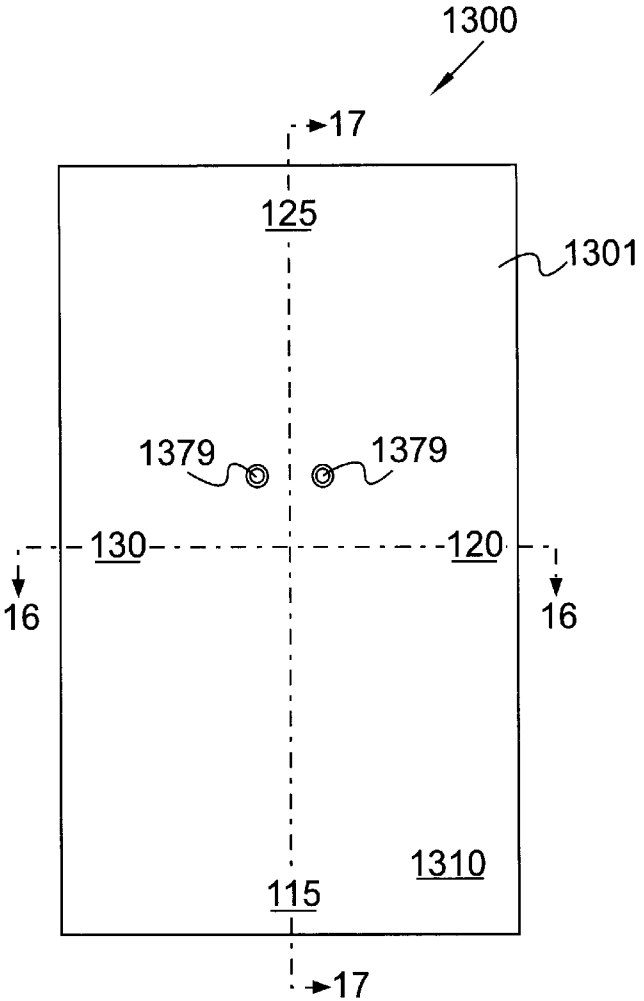
Figure 14:
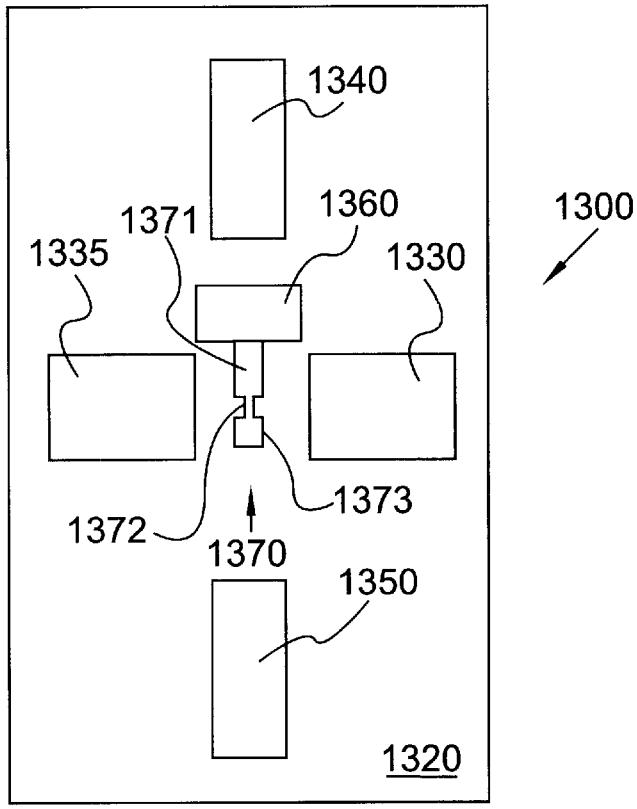
Figure 15:
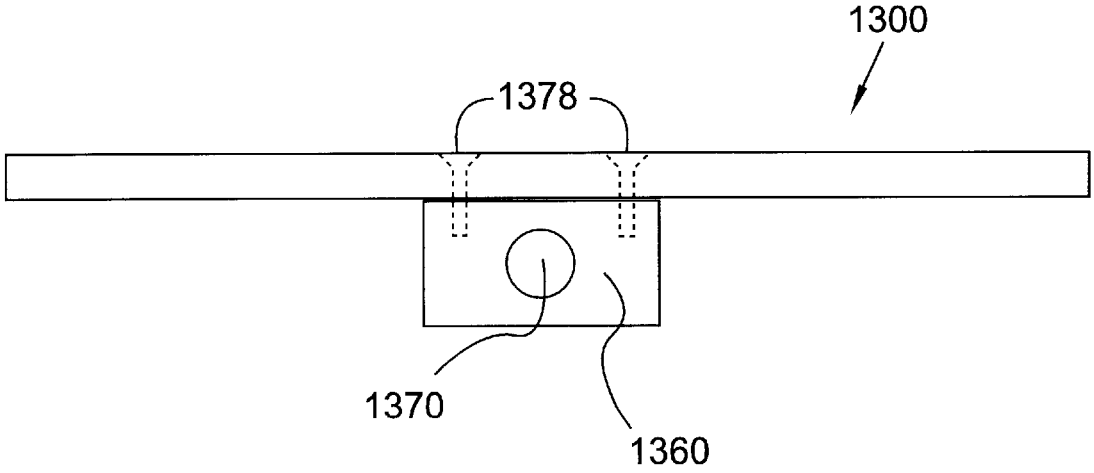

Turning now to FIGS. 12 and 14 along with FIGS. 7 through 11, top alignment depression 1340 is sized horizontally and vertically and placed to provide a surface on which end 960 may slide. As such, the top alignment depression 1340 vertically aligns the end 960, in the sense that the end 960 will move vertically in the depression 1340 when pivot plate 1301 is pressed near location 125. Preferably, the depression is sized to such a depth that the end's 960 travel will be vertically aligned. Similarly, bottom alignment depression 1350 is sized horizontally and vertically and placed to provide a surface on which end 961 may slide. The bottom alignment depression 1340 vertically aligns the end 961, in the sense that the end 961 will move vertically in the depression 1350 when pivot plate 1301 is pressed near location 115. Preferably, the depression is sized to such a depth that the end's 961 travel will be vertically aligned.

Right alignment depression 1330 is sized horizontally and vertically and placed to provide a surface on which end 950 may slide. Note that "right" alignment depression 1330 will be on the left when top switch unit 1300 is coupled to bottom switch unit 900, when depression 1340 is above depression 1350, and when the reference viewpoint is from a location looking directly at front surface 1310 of top switch unit 1300. The right alignment depression 1330 horizontally aligns the end 950, in the sense that the end 950 will move horizontally in the depression 1330 when pivot plate 1301 is pressed near location 130. Preferably, the depression is sized to such a depth that the end's 950 travel will be horizontally aligned. Similarly, left alignment depression 1335 is sized horizontally and vertically and placed to provide a surface on which end 951 may slide. Note that "left" alignment depression 1335 will be on the right when top switch unit 1300 is coupled to bottom switch unit 900, when depression 1340 is above depression 1350, and when the reference viewpoint is from a location looking directly at front surface 1310 of top switch unit 1300. The left alignment depression 1335 horizontally aligns the end 951, in the sense that the end 951 will move in the depression 1335 when pivot plate 1301 is pressed near location 120. Preferably, the depression is sized to such a depth that the end's 951 travel will be horizontally aligned.

It should be noted that depressions 1340 and 1350 are not necessarily deep enough to stop the vertical contacting spring 920 from moving vertically. Similarly, depressions 1330 and 1335 are also not necessarily deep enough to stop the horizontal contacting spring 930 from moving horizontally. Travel stops in depressions 1340, 1330, 1335, and 1350 are not desirable as top switch unit 1300 in field installation requires pushing down on all four sides, allowing pivot pin 1370 to slide under pivot bar 1433 (of pivot 940), then releasing pressure on the top switch unit 1300 to set the pivot pin 1370 in a locked position using the depressions as an alignment lock. Thus, for installation, the top switch unit 1300 is pushed against spring ends 950, 951, 960 and 961 far enough to allow pivot pin 1370 to slide under pivot bar 1433 of pivot 940 of bottom switch 900. Notch 1372 of pivot pin 1370 is a center pivot point that mates with the thinner location 1431 of pivot bar 1433. Spring ends 950, 951, 960 and 961 slip into depressions 1330, 1335, 1340 and 1350, locking in place as pressure is taken away from the top switch unit 1300. This allows the notch 1372 and thinner location 1431 to match at essentially one point while keeping the springs 920, 930 in horizontal and vertical alignment. Removal might require a thin metal tool to release the springs 930, 930 from the depressed areas 1330, 1335, 1340, and 1350 while pressing the front side 1310 of pivot plate 1301 and sliding the top switch unit 1300 vertically to allow the pivot pin 1370 to be free from the pivot 940.

Referring now to FIGS. 16 and 17, FIG. 16 shows a cross-sectional (along cross-section 16) view of the most preferred movable electric switch system 1100, while FIG. 17 shows another cross-sectional (along cross-section 17) view of the most preferred embodiment of the movable electric switch system 1100. Movable electric switch system 1100 comprises movable electric switch 100 that is attached to wall 101 and that is shown in its completely covered position, covering underlying control area 141. In this example, underlying control area 141 contains a control panel 140 that is a touch screen. Movable electric switch 100 comprises an electric switch 1460, which in the most preferred embodiment is a four position electric switch, a decorative cover plate 110, a movement mechanism (to be shown in more detail in reference to FIG. 17), and a base unit 300. Touch screen 140 is electrically coupled to electric switch 1460 through connection 7030 and ribbon cable 7040, which would connect to each spring contact 8080 through 8084 (these connections are not shown herein but could be any connection known to those skilled in the art or developed in the future). As previously discussed, electric switch 1460 communicates its current position (if any) to control panel circuitry 140 through spring contacts 8080 through 8084. Most of the elements of movable electric switch system 1100 have already been discussed; consequently, only additional elements will herein be discussed.

One particularly important element is pivoting mechanism 1470. Pivoting mechanism 1470 allows the decorative cover plate 110 and the pivot plate 1301 to which it is attached to pivot horizontally and vertically about one point. Pivoting mechanism 1470 comprises pivot 940 and pivot pin 1370 having notch 1372. Pivot 940 comprises pivot bar 1433 having a thinner and preferably fairly round thinner location 1431, two fastening mechanisms 1410, 1420, and spacers 1440, 1450. Fastening mechanisms 1410, 1420 attaches the vertical 920 and horizontal 930 contacting springs to the bottom plate 910 and attaches the pivot body and its pivot location 1431 to the bottom plate 910. Any mechanism for attaching these elements to the bottom plate may be used.

Spacers 1440 and 1450 act to raise the level of thinner location 1431 to allow pivot pin 1370 to pass underneath the thinner location 1431 and be positioned such that notch 1372 on pivot pin 1370 will contact and mate to thinner location 1431. During initial installation, the decorative cover plate 110 and/or pivot plate 1301 are pressed downward and toward bottom plate 910 so that body 1373 can clear pivot location 1431. It should be noted that standoff 1360 and the pivot pin 1370 location are designed to allow the two pivot locations to properly mate. After notch 1372 contacts and mates to thinner location 1431, end body 1373 and connecting body 1371 keep thinner location 1431 fixed vertically. Similarly, pivoting bar 1433 fixes the horizontal position of notch 1372. Thus, the most preferred embodiment allows for movement primarily along two axes.

In this example, standoff 1361 comprises a bore 1361 into which connecting body 1371 of pivot pin 1370 is press fit. It should be noted that there are many different pivoting mechanisms 1470 that may be used with the current invention. For example, many joysticks have pivoting mechanisms suitable for use with the current invention. Any pivoting mechanism that allows an electric switch to have more than two positions may be used with the current invention.

Movement mechanism 980 in this example comprises edges 2710, 2720 of bottom plate 910 and grooves 156, 152 of rails 155, 151. This allows the electric switch 1460 to be slid horizontally to reveal the control panel 140 that resides in the underlying control area 141.

Decorative cover plate 110 may be attached to pivot plate 1301 through any mechanism known to those skilled in the art, such as adhesive, screws, tape, etc. Preferably, the decorative cover plate 110 would be attached through adhesive that is appropriate for the decorative cover plate 110 and the pivot plate 1301.

Turning to all of the figures, it is preferable that fastening mechanism 1420 be electrically connected to through hole/surface contact 9090 and to the vertical 920 and horizontal 930 contacting springs. This will provide a complete electrical circuit from a control panel, through one of the spring contacts 8080, 8081, 8083, and 8084, through one of the contacts (1110, 1130, 1140, 1120), through a horizontal 930 or vertical 940 contacting spring, throughhole 9090 and run 9091, through contacting run 9093, through contacting spring 8082, and back to the control panel.

What has been described so far is the most preferred embodiment of the present invention, which has a four position electric switch that can horizontally slide to reveal an underlaying control area containing a control panel. The movable electric switch and system thus allow a control panel or other underlying control area to be covered, yet also retains a high level of functionality. The most preferred embodiment of the present invention is preferred because the distance between the electric switch and the wall is minimal, and the switch can be operated when the movable electric switch is in its fully covered position, its fully exposed or uncovered position, and any position therebetween. Moreover the cover used for the movable electric switch can be as large as desired. The upcoming figures contain less preferred embodiments of the present invention.

Figure 19:
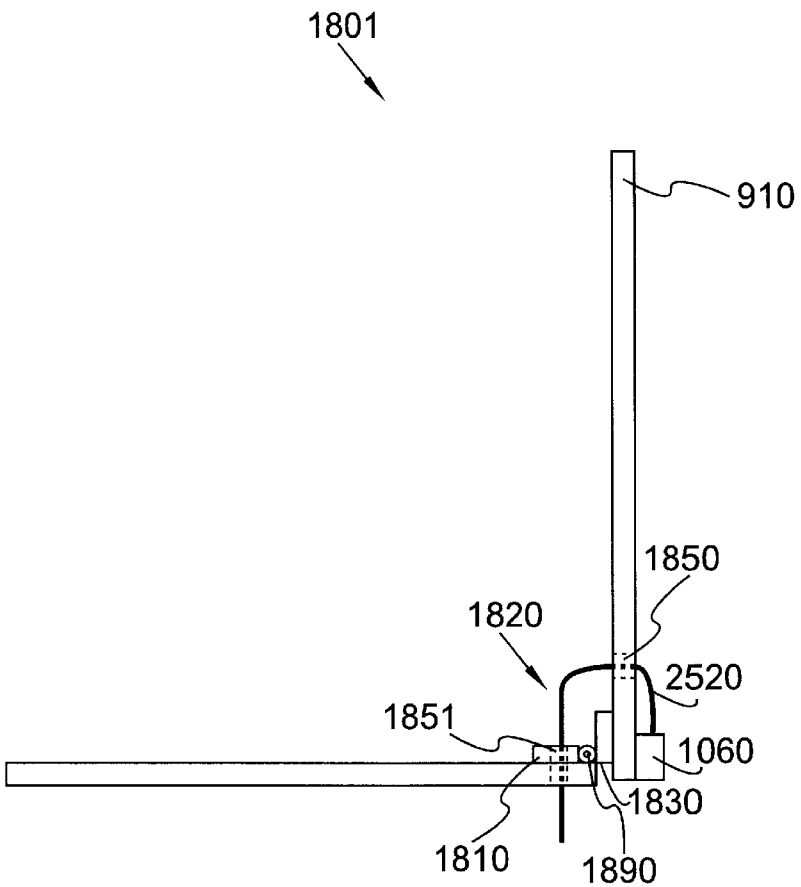
FIGS. 18 and 19 are top and side views, respectively, of another movement mechanism, attached to a mounting plate and a bottom switch unit, in accordance with a preferred embodiment of the present invention.
Figure 18:
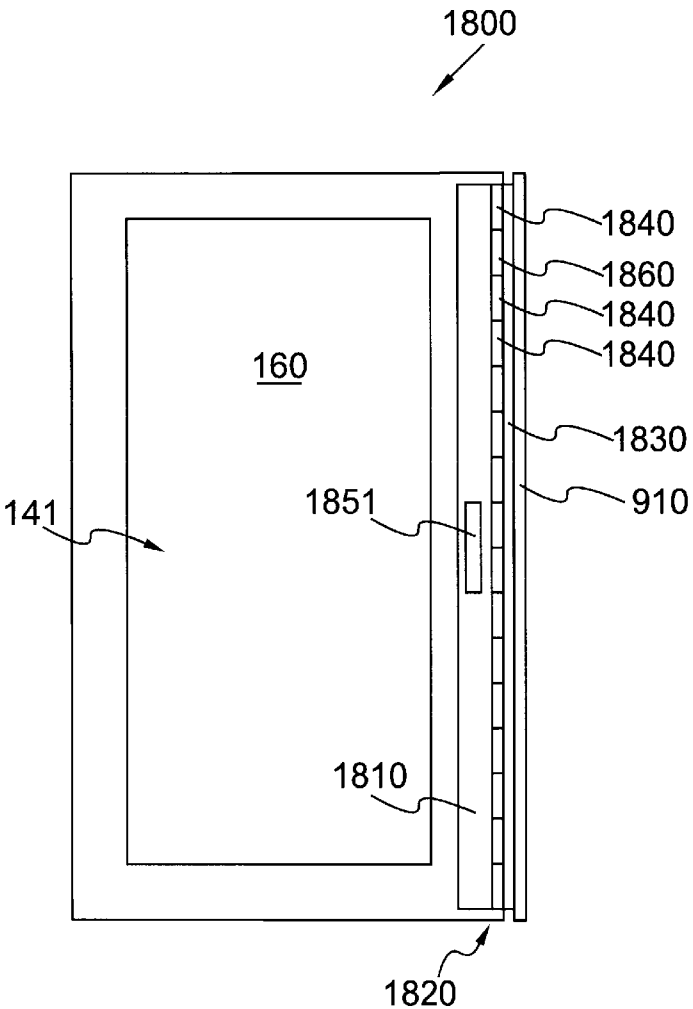

Turning to FIGS. 18 and 19, top 1800 and side 1801 views, respectively of a bottom switch plate 910 mounted to a base unit 150 are shown. The movement mechanism in this example comprises a hinge 1820 having two sides, the bottom plate side 1830 and the base unit side 1810. The bottom plate side 1830 comprises a number of bottom plate cylinders 1840 interspersed between base unit cylinders 1860 on the base unit side 1810. Pin 1890 holds the two sides 1810, 1830 together by passing through the cylinders 1860, 1840. Thus, the movement mechanism allows the electric switch (of which only the bottom plate 910 is shown) to be rotated about one pivot point (the pin 1890) to reveal the underlying control area 141 and to also cover the underlying control area 141. Notches 1850 and 1851 are used to route a ribbon cable 2520 from a bottom plate connector 1060 to a control panel (not shown).

The reasons that this is a less preferred embodiment are as follows. First, when electric switch is rotated into its fully exposed or uncovered position (as shown in FIGS. 18 and 19), the electric switch will no longer be parallel to the wall. Thus, what was once "left" on the electric switch, and as compared to a wall, will now be at a different position. It will be harder to discern how to operate the electric switch. Second, the ribbon cable will be hard to route such that it is not seen. For instance, in the example of FIGS. 18 and 19, the ribbon cable would easily be seen. Although it is possible to route the ribbon cable differently, most likely all of the possible routes will still expose the ribbon cable. Finally, when the electric switch is in its most exposed position, the decorative cover plate (not shown) will be very close to the wall. In fact, the size of the decorative cover plate will likely have to be reduced to fit on the embodiment of FIGS. 18 and 19.

It should be noted that the electric switches do not have to contain four positions. Four positions are ideal, as this allows two different electric devices to be easily controlled. However, electric switches having more or fewer positions may be used. For instance, horizontal contacting spring 930 (see FIGS. 7 and 8, among others) could be removed to create a two position electric switch.

The embodiments and examples set forth herein were presented in order to best explain the present invention and its practical application and to thereby enable those skilled in the art to make and use the invention. However, those skilled in the art will recognize that the foregoing description and examples have been presented for the purposes of illustration and example only. The description as set forth is not intended to be exhaustive or to limit the invention to the precise form disclosed. Many modifications and variations are possible in light of the above teaching without departing from the spirit and scope of the forthcoming claims. In particular, any methods herein are not necessarily in the order described, unless an order is necessary.

What is claimed is:

1. A movable electric switch comprising:

a base unit comprising an opening, the opening containing at least one control area;

an electric switch comprising at least one position, the electric switch covering the opening; and a movement mechanism coupled to the electric switch and the base unit and allowing the electric switch to be moved to reveal at least part of the opening such that the at least one control area may be accessed, the electric switch remaining in electrical contact with the base unit when the control area is revealed.

2. The movable electric switch of claim 1 wherein each position of the electric switch completes an electric circuit when the electric switch is moved to select that position.

3. The movable electric switch of claim 1 wherein the electric switch further comprises a bottom plate having first and second edges, wherein the movement mechanism is coupled to the base unit and further comprises two parallel rails and the first and second edges, each rail comprising a groove, wherein the first edge slidably engages the groove in one of the rails and the second edge slidably engages the groove in the other rail, whereby the movement mechanism allows the electric switch to be slid in the two parallel rails thereby revealing at least part of the opening.

4. The movable electric switch of claim 1 wherein the electric switch further comprises a bottom plate having a left edge, wherein the movement mechanism further comprises a hinge, the hinge coupled to the base unit and to the bottom plate proximate the left edge, whereby the movement mechanism allows the electric switch to be rotated about the hinge thereby revealing at least part of the opening.

5. The movable electric switch of claim 1 wherein the electric switch comprises four positions.

6. The movable electric switch of claim 1 wherein the electric switch comprises two positions, wherein the electric switch further comprises bottom switch unit comprising a bottom plate having a top surface, two contacts attached to the top surface of the bottom plate, and a first contacting spring having a middle end and two outer ends, wherein the first contacting spring is attached to the top surface of the bottom plate near the middle of the spring, the first contacting spring shaped such that each of the two outer ends of the first contacting spring is positioned a distance away from the bottom plate, wherein the two contacts are separated by a second distance and each is positioned underneath the first contacting spring between the middle of the first contacting spring and one of the outer ends of the first contacting spring, whereby the first contacting spring and the two contacts provide the two positions of the electric switch.

7. The movable electric switch of claim 6 wherein the electric switch comprises an additional two positions, wherein the bottom plate further comprises an additional two contacts attached to the top surface of the bottom plate, and a second contacting spring having a middle end and two outer ends, wherein the second contacting spring is attached to the top surface of the bottom plate near the middle of the spring, wherein the second contacting spring is placed perpendicular to the other contacting spring, the second contacting spring shaped such that each of the two outer ends of the second contacting spring is positioned a distance away from the bottom plate, wherein the additional two contacts are separated by a third distance and each is positioned underneath the second contacting spring between the middle of the second contacting spring and one of the outer ends of the second contacting spring, whereby the second contacting spring and additional contacts provide the additional two positions of the electric switch.

8. The movable electric switch of claim 7 wherein the bottom switch unit further comprises a pivot connected to the bottom plate.

9. The movable electric switch of claim 8 wherein the pivot comprises a thinner location, wherein the electric switch further comprises a top switch unit comprising a pivot plate having a back surface and a pivot pin having a notch, the pivot pin coupled to the back of the pivot plate and spaced a fifth distance from the back of the pivot plate, wherein pivot plate is positioned such that each of the outer ends of the first and second contacting springs abuts the back surface of the pivot plate and such that the thinner location of the pivot and the notch of the pivot pin mate, whereby the thinner location and notch allow pivoting motion in a plurality of directions.

10. The movable electric switch of claim 9 wherein the pivot plate comprises four alignment depressions in its back surface, wherein each of the alignment depressions is positioned to abut and mate with each of the outer ends of the first and second contacting springs.

11. The movable electric switch of claim 10 further comprising a decorative cover plate coupled to a front surface of the pivot plate.

12. The movable electric switch of claim 1 wherein the electric switch comprises a decorative cover plate.

13. The movable electric switch of claim 1 wherein the electric switch comprises at least two positions and a pivot mechanism, the pivot mechanism allowing each of the at least two positions to be selected.

14. A movable electric switch system comprising:

an underlying control area;

an electric switch comprising at least one position, the switch covering the underlying control area; and a movement mechanism coupled to the electric switch and allowing the electric switch to be moved to reveal at least part of the underlying control area such that the underlying control area may be accessed, the electric switch remaining in electrical contact with the base unit when the control area is revealed.

15. The movable electric switch system of claim 14 wherein the underlying control area comprises a control panel.

16. The movable electric switch system of claim 14 wherein the electric switch is electrically coupled to the underlying control area.

17. A method of controlling electronic devices, the method comprising the steps of:

moving an electric switch to reveal an opening containing a control panel, the electric switch remaining in electrical contact with a base unit containing the opening when the electric switch is moved; and accessing the control panel.

18. The method of claim 17 further comprising the step of moving the electric switch to completely cover the opening containing the control panel.

19. The method of claim 17 wherein the step of moving an electric switch to reveal an opening containing a control panel comprises the step of sliding the electric switch in a first direction, thereby revealing the opening.

20. The method of claim 17 wherein the step of moving an electric switch to reveal an opening containing a control panel comprises the step of pivoting the electric switch about at least one pivot point, thereby revealing the opening.

21. The method of claim 17 wherein the step of moving an electric switch to reveal an opening containing a control panel comprises the step of moving the electric switch from a fully covered position, wherein the opening is completely covered and the electric switch overlies the opening, to a fully exposed position, wherein the opening has a substantial amount of its area exposed.

* * * * *